United States Patent [19]

Griffin

[11] Patent Number: 4,857,804

[45] Date of Patent: Aug. 15, 1989

[54] TUNGSTEN-HALOGEN LAMP WITH METAL ADDITIVE

[75] Inventor: Robert M. Griffin, South Hamilton, Mass.

[73] Assignee: GTE Products Corporation, Danvers, Mass.

[21] Appl. No.: 849,652

[22] Filed: Mar. 31, 1986

Related U.S. Application Data

[63] Continuation of Ser. No. 706,245, Feb. 28, 1985, abandoned, and a continuation-in-part of Ser. No. 372,512, Apr. 28, 1982, abandoned.

[51] Int. Cl.[4] ..... H01K 1/56; H01K 1/50

[52] U.S. Cl. ..... 313/557; 313/559; 313/579

[58] Field of Search ..... 313/579, 559, 557

[56] References Cited

U.S. PATENT DOCUMENTS

| | | | |
|---|---|---|---|
| 3,227,909 | 1/1966 | Schilling et al. | 313/579 X |
| 3,496,401 | 2/1970 | Dumbaugh, Jr. | 313/579 |
| 3,798,491 | 3/1974 | Malm | 313/578 X |
| 3,843,899 | 10/1974 | T'Jampens et al. | 313/579 |
| 3,912,960 | 10/1975 | Danko | 313/579 |
| 4,296,351 | 10/1981 | Kimball et al. | 313/579 |
| 4,354,137 | 10/1982 | Martin et al. | 313/579 |
| 4,524,302 | 6/1985 | Berlec | 313/579 X |

FOREIGN PATENT DOCUMENTS

| | | | |
|---|---|---|---|
| 2803122 | 7/1979 | Fed. Rep. of Germany | 313/579 |
| 2067832 | 7/1981 | United Kingdom | 313/557 |

*Primary Examiner*—Palmer C. DeMeo
*Attorney, Agent, or Firm*—Carlo S. Bessone

[57] ABSTRACT

A tungsten-halogen lamp achieves long life in any burning orientation by the inclusion within the lamp of copper, which reduces filament sag and filament corrosion.

13 Claims, 1 Drawing Sheet

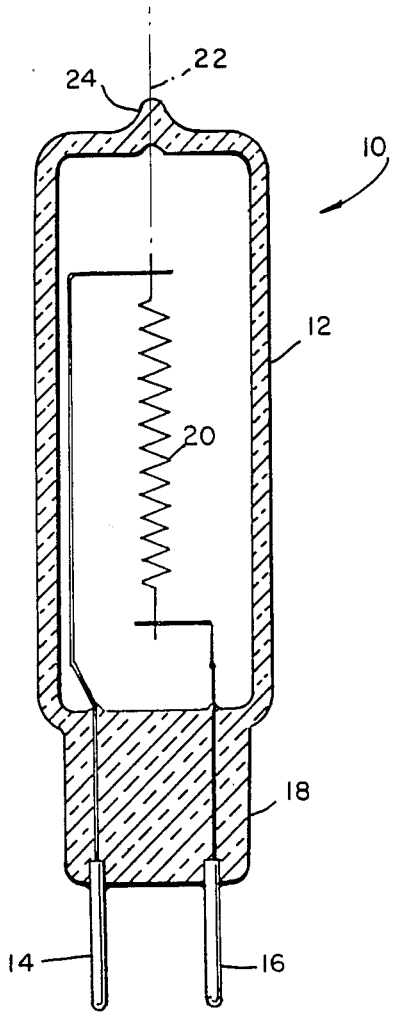
24
22
10
12
20
18
14
16

TUNGSTEN-HALOGEN LAMP WITH METAL ADDITIVE

This application is a continuation of application Ser. No. 706,245 filed 2/28/85, now abandoned, which is a continuation-in-part of application Ser. No. 372,512, filed Apr. 28, 1982, now abandoned.

CROSS-REFERENCES TO RELATED APPLICATIONS

U.S. Ser. No. 372,508, now U.S. Pat. No. 4,451,760; U.S. Ser. No. 372,519; U.S. Ser. No. 372,594, now U.S. Pat. No. 4,430,599; and U.S. Ser. No. 372,518, now U.S. Pat. No. 4,449,070 filed concurrently herewith, and assigned to the assignee of the instant application, contain related subject matter.

TECHNICAL FIELD

This invention relates to incandescent lamps and more particularly to tungsten-halogen incandescent lamps. Still more particularly it relates to lamps of the latter variety having means incorporated therewith to prevent filament sagging, thus allowing long life and the ability to be lighted in either a vertical or horizontal mode.

BACKGROUND OF THE INVENTION

The majority of incandescent lamps today use a filament made from tungsten wire which can be of the single or coiled coil design. When initially energized to incandescence, the filament will both metallurgically recrystalize and physically sag under gravitational attraction.

Coiled coil filaments sag more than single coils and fine wire sags more than heavy wire.

In the vertical position sag is characterized by a collapsing of turns with open turns at the top and compression at the bottom. Sag in the horizontal position is characterized by the formation of use or more catenaries depending on the number of filament support wires.

The prelimary sag in tungsten filaments has never been completely eliminated. However, it can be significantly reduced by employing a controlled heating process at the time of initial lightup. Two different processes for doing this are now in common use and are briefly described as follows.

1. Pre-stabilizing is a process used mainly on coiled coil filaments for halogen lamps. It involves raising the coil temperature above 2400° C. in vacuum prior to removing the primary mandrel and while the secondary coiling is mounted on a threaded rod. The result is a brittle coil which requires hand mounting. This, plus the pre-stabilizing process make for a very expensive coil. However, preliminary sag at initial coil lightup is minimal.

2. Flashing is an alternate method of stabilizing the filament. It is done after the coil is mounted in the lamp and can be performed either before or after tipoff. Since the filament as received is not brittle, it does not require hand mounting and can therefore be mounted inexpensively via high speed automatic equipment. Initial lightup under these conditions results in more preliminary sag than on pre-stabilized coils.

Unfortunately, the filament in an incandescent lamp will continue to sag during subsequent lamp operation in spite of pre-stabilizing or flashing. This is generally attributed to a slippage at the grain boundaries. The condition is known to be aggravated by the presence of oxygen in the gaseous state. This accounts for a higher degree of sag in halogen lamps because the halogen regenerative cycle retains a higher percentage of oxygen in the gaseous state than there is in a non-halogen incandescent lamp. Generally, the sag in non-halogen incandescent lamps is not severe because most of the residual oxygen is tied up on the bulb wall as tungsten-oxide, a colorless solid condensate. Thus, a sufficient quantity of oxygen is not available in the gaseous state to promote sag.

However, in halogen lamps this secondary sag can be a serious problem due to the fact that any oxides present can be reduced by the halogen additive (HBr in this case) which promotes the presence of free oxygen in the gaseous state. As was the case with preliminary sag, fine wire filaments of the coiled coil configuration are especially susceptible to serve secondary sag in a halogen atmosphere. Also, chemical corrosion of the wire in the cooler sections of the filament results in a significant reduction in life as caused by thinning and premature arcing. This is more pronounced in fine wire than it is in heavy wire.

These problems become even more aggravated in the case of a tungsten-halogen lamp employing a low wattage, line voltage, coiled coil filament. An example of such a coiled coil would be one rated at 100 watts and 120 volts. Such a coil is formed from fine tungsten wire (12.5 mg/200 mm with a diameter of 0.0025 inches) and filament sag and short life due to the presence of the halogen would be a serious problem.

The use of halogen in an incandescent lamp generally allows for an envelope which is drastically reduced from the size that would be required by a non-halogen version of the same wattage. Specifically, the 100 watt filament described above is normally sealed in an A19 glass bulb under non-halogen conditions but can be sealed in a T5 glass envelope when halogen is added. The relative volumes of these two bulbs are:

The use of this drastically smaller T5 envelope provides for higher fill pressures which in turn results in a lamp performance increase. However, the filament is now significantly closer to the bulb wall of the T5 and filament sag while burning in any position other than the vertical results in the coil moving closer to the wall. The result is a local increase in bulb wall temperature with a corresponding increase in outgassing of the glass which can be deleterious to lamp performance. In the most severe case, the filament can (and has) sagged to the point where it makes contact with the bulb wall. The result is thermal cracking or melting of the bulb wall which terminates lamp life prematurely.

There are numerous techniques now in use attempting to solve the problem of sag in halogen lamps of this type. However, each one introduces new problems which forces a compromise with respect to lamp performance. Some of the more widely used techniques are briefly described here.

1. Center Support—Sag reduction can be restricted significantly by using a third wire which loops around the center of the coil and is electrically isolated from the two end lead wires. Sag in any position except vertical will result in two catenaries whose displacement from the original coil center line is less than that of an unsupported single catenary. However, contact between coil and support results in a local cool spot which then becomes the center of increased halogen activity with its associated tungsten corrosion. The coil will ultimately fail prematurely due to the accelerated thinning in the area of contact with the center support wire. Also, a center support makes lamp manufacture more difficult and costly.

2. Pre-Stabilized Coil—As previously described, this process results in less overall sag but is restricted to hand mounting due to coil embrittlement. This latter restriction results in a significant increase in manufacturing costs which is intolerable in low cost lamp types, such as would be suitable for general home illumination.

3. Methane Light Up—This is a well-known process employed during the lamp exhaust cycle whereby the filament is energized in an atmosphere of nitrogen and methane ($CH_4$). The literature alludes to reduced coil sag as a result and attributes this benefit to a reaction between the tungsten filament and the carbon in the methane. However, tests run on a 100 watt, 120 volt coil, such as that described above, resulted in absolutely no reduction in coil sag when compared with control lamps which were not lighted in methane.

4. Other Halides—The halogen additive often used is Hydrogen Bromide (HBr). It is considered by some lamp manufacturers to be too corrosive and therefore less desirable than the carbonaceous halides. Tests run fail to show any advantages to using this type of halide ($CH_{2Br2}$, for example). A serious defect arises when using this gas. The result is a significant attenuation of light output which is caused by a carbon layer deposited on the inner bulb wall during initial lightup when the $CH_2Br_2$ is decomposed into a more elemental form.

5. Reduced Halogen Content—It has been shown by tests that a reduction in halogen content in the fill gas will give rise to a corresponding reduction in filament sag and corrosion. Unfortunately, it will also result in an increase in the percentage of lamps which will turn black prematurely due to failure of the halogen regnerative cycle. Lamp blackening of any halogen lamp constitutes lamp failure even if the filament continues to burn. No reputable lamp manufacturer would tolerate such a condition.

6. Condenser Discharge Flashing—This is a process which attempts to achieve the results displayed by a pre-stabilized filament while circumventing the brittle coil/hand mount problems of the latter. It involves stabilizing the filament after mounting either during the exhaust cycle or after tipoff. A condenser is used to discharge a high energy pulse through the coil. The pulse duration is very short compared to the conventional series-ballast flashing process used by many lamp manufacturers. This shorter time duration significantly reduces the heat sinking effect on the coil's metallurgical structure by the lead-in clamps. Thus, the coil is allowed to stabilize more completely in the clamp are from where much of the sag problem emanates. However, it is felt that this method will achieve, at best, only a portion of the effect desired, and that at increased cost of manufacture.

7. Low Sag Coil Design—It has been demonstrated that the coil design which exhibits the least amount of sag is one which has the tightest T.P.I. and lowest mandrel to wire (coil) ratio with respect to both the primary and secondary windings of the coiled coil filament. All of this must be done, however, within the allowable limits of prescribed coil manufacturing practice. Like condenser discharge flashing, it is felt that low sag coil design will achieve only a portion of the desired effect.

DISCLOSURE OF THE INVENTION

It is, therefore, an object of this invention to obviate the disadvantages of the prior art.

It is another object of the invention to enhance the tungsten-halogen lamps.

Yet another object of the invention is to significantly reduce primary and secondary filament sag in incandescent lamps.

Still another object of the invention is the reduction of halogen corrosion of the filament of a tungsten-halogen filament.

These objects are accomplished, in one aspect of the invention, by the provision of a lamp which includes within the filament environment an effective amount of copper to substantially eliminate primary and secondary filament sagging as well as significantly reducing halogen corrosion of the filament in lamps which include a halogen fill.

The invention allows the fabrication of halogen lamps in wattage varieties and voltage requirements suitable for replacement of the usual incandescent lamps normally used for home lighting. The lamps are characterized by performance levels far superior to conventional incandescent lamps. This enhanced performance can be offered in a variety of forms such as reduced power consumption, increased lumen output, and longer life or a combination of any of the three which is desired by the customer. Excellent life ratings are also achieved whether the lamp is burned with the filament in vertical or horizontal orientation.

BRIEF DESCRIPTION OF THE DRAWING

The single figure diagrammaticlly illustrates a lamp employing the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing and greater particularity, there is shown a tungsten-halogen lamp 10 having a light transmitting, hermetically sealed glass envelope 12. The envelope 12 can be fabricated from quartz or hard glass tubing such as, for example, Corning 1720 alumino silicate glass.

In a preferred embodiment the envelope 12 is constructed from T5 tubing (0.625" O.D.; 0.040" wall) and has an overall length of about 1.675" with a volume of 5.2 cc. In a second preferred embodiment the envelope 12 is constructed from T4 tubing (0.500" O.D.; 0.040" wall) with an overall length of 1.675" and a volume of 2.0 cc.

A long lead-in wire 14 and a short lead-in wire 16 are sealed in a press 18 and extended into the envelope 12. Lead-in wires 14, 16 are made of metallic material such as molybdenum. A tungsten filament 20, preferably in the form of a coiled coil and rated, for example, as 100 watts at 120 volts, is clamped between the internal ends of the lead-in wires and extends along the longitudinal axis 22 of envelope 12. An exhaust and filling port 24 is provided, as is conventional. After exhausting, lamp 10 is provided with a suitable atmosphere or fill gas containing a halogen. In a preferred embodiment the fill gas comprises, by volume, 88% krypton; 11.79% nitrogen;

and 0.21% hydrogen bromide (HBr) at a high pressure; i.e, between about 1 to 10 atmospheres, with the preferred fill pressure being 5 atmospheres absolute at room temperature. Also included within the envelope 12 is a quantity of copper which can be, for example, a thin layer of copper coating on the surface of tungsten filament 20. The copper can be deposited by electroplating, a process which is well known. This process is capable of very accurately depositing a controlled amount of copper on the filament and can be closely monitored by measuring the weight of copper added to the filament. An optimum weight of copper for a 100 watt, 120 volt coil would be about 30 micrograms. During the initial lightup of the filament in the sealed lamp envelope, the copper coating becomes vaporized and ultimately deposits on the cooler surfaces of the envelope and lead wires. Subsequent lamp operation generates a high temperature thermochemical reaction between the bromine, copper, tungsten and oxygen. It has been discovered that including copper within the lamp reduces filament sag and filament corrosion.

Life test results at 120 volts with this construction without copper addition showed the following.

Vertical burn failures were characterized by clean lamps with normal filament failure. Horizontal burn failures were characterized by clean lamps and coils that either sagged to the bulb wall or arced prematurely due to corrosion thinning of the tungsten wire.

When copper was included within the lamp envelope, life tests showed the following results.

All failures with copper were characterized by clean lamps with normal filament failure.

Microscopic examination of samples both with and without the copper additive was performed throughout the life test program.

1. Non-copper samples revealed a progressive build-up of tungsten dendritic deposits on the primary coil near the lead clamps. This is an obvious indication of a high level of halogen activity which can (and did) give rise to a reduction in filament life.

2. Lamp samples containing copper revealed no dendritic growth at any time during life. However, observations were noted that appear to be entirely new to halogen lamps. Copper appeared to progressively build up as a coating on the molybdenum lead wires but not on the inside surface of the glass. This is an indication of a successful copper-halogen cycle with no deleterious effects to the regenerative cycle as evidenced by the lack of bulb wall blackening throughout life.

Thus, the copper appears to be acting as an oxygen getter with a two-fold result.

1. Removal of oxygen reduces its concentration in the gaseous state which is a known cause of sag in tungsten filaments. This is true for both halogen and non-halogen types.

2. Removal of oxygen from the gaseous state results in the reduction of halogen activity which is known to be increased via additional amounts of gaseous oxygen.

In summary, therefore, it can be stated that the addition of copper to halogen lamps with large fine wire filaments results in the elimination of premature coil failure as caused by sag and/or halogen corrosion.

While there have been shown and described what are at present considered to be the preferred embodiments of the invention, it will be apparent to those skilled in the art that various changes and modifications can be made herein without departing from the scope of the invention as defined by the appended claims.

I claim:

1. An incandescent lamp comprising:

a light-transmitting hermetically sealed, glass envelope having a longitudinal axis;

two lead-in wires of metallic material sealed in said envelope;

a tungsten filament attached to said lead-in wires and extending substantially along said longitudinal axis;

a fill gas within said envelope, said fill gas including a halogen; and an amount of copper deposited on the surface of said filament and being in the form of a thin layer of substantially copper metal prior to initial lightup of said tungsten filament contained within said envelope, said copper metal being in addition to said metallic material of said lead-in wires, said copper being effective to substantially eliminate sagging of said filament regardless of the physical orientation of said lamp during use.

2. The lamp of claim 1 wherein said envelope has a volume of about less than 6 cc.

3. The lamp of claim 2 wherein said envelope has a volume of 2.0 cc.

4. The lamp of claim 1 wherein said fill gas comprises krypton, nitrogen and hydrogen bromide in amounts of about 88% krypton; 11.79% nitrogen; and 0.21% hydrogen bromide.

5. The lamp of claim 1 wherein said lead-in wires are made of molybdenum.

6. The lamp of claim 1 wherein said filament is a coiled coil.

7. The lamp of claim 6 wherein said glass envelope is single ended and formed from an alumino silicate glass.

8. The lamp of claim 7 wherein the fill pressure of said fill gas is about 1 to 10 atmospheres absolute at room temperature.

9. The lamp of claim 7 wherein the fill pressure of said fill gas is about 5 atmospheres absolute at room temperature.

10. The lamp of claim 1 wherein said filament is rated as 100 watts at 120 volts.

11. The lamp of claim 1 wherein said thin layer of copper is deposited by electroplating.

12. The lamp of claim 1 wherein said copper vaporizes and deposits on said envelope and said lead-in wires during lightup of said filaments.

13. An incandescent lamp comprising:

a light-transmitting hermetically sealed, glass envelope having a longitudinal axis;

two lead-in wires of metallic material sealed in said envelope;

a tungsten filament attached to said lead-in wires and extending substantially along said longitudinal axis;

a fill gas within said envelope, said fill gas including a halogen; and an amount of copper in the form of substantially copper metal prior to initial lightup of said tungsten filament contained within said envelope, said copper metal being in addition to said metallic material of said lead-in wires, said copper being in an amount equal to about 30 micrograms effective to substantially eliminate sagging of said filament regardless of the physical orientation of said lamp during use.

* * * * *